US005848327A

United States Patent [19]

Badesha et al.

[11] Patent Number: 5,848,327

[45] Date of Patent: Dec. 8, 1998

[54] COATING COMPOSITIONS FOR DEVELOPMENT ELECTRODES AND METHODS THEREOF

[75] Inventors: Santokh S. Badesha, Pittsford; George J. Heeks, Rochester; Arnold W. Henry, Pittsford; Paul C. Julien, Webster; David J. Gervasi, Rochester; George J. Bingham, Webster, all of N.Y.

[73] Assignee: Xerox Corporation, Stamford, Conn.

[21] Appl. No.: 841,235

[22] Filed: Apr. 29, 1997

[51] Int. Cl.[6] ..... G03G 21/00

[52] U.S. Cl. ..... 399/99; 399/266

[58] Field of Search ..... 399/98, 99, 266, 399/290, 291

[56] References Cited

U.S. PATENT DOCUMENTS

| | | | |
|---|---|---|---|
| 4,868,600 | 9/1989 | Hays et al. | 399/266 |
| 4,984,019 | 1/1991 | Folkins | 399/99 |
| 5,010,368 | 4/1991 | O'Brien | 399/266 |
| 5,124,749 | 6/1992 | Bares | 399/266 |
| 5,172,170 | 12/1992 | Hays et al. | 399/266 |
| 5,300,339 | 4/1994 | Hays et al. | 428/36.9 |
| 5,311,258 | 5/1994 | Brewington et al. | 399/266 |
| 5,448,342 | 9/1995 | Hays et al. | 399/285 |

*Primary Examiner*—William Royer
*Attorney, Agent, or Firm*—Annette L. Bade

[57] ABSTRACT

An apparatus and process for reducing accumulation of toner from the surface of an electrode member in a development unit of an electrostatographic printing apparatus by providing a composition coating including a polymer, lubricant and inorganic material, on at least a portion of the electrode member.

18 Claims, 3 Drawing Sheets

COATING COMPOSITIONS FOR DEVELOPMENT ELECTRODES AND METHODS THEREOF

CROSS REFERENCE TO RELATED APPLICATIONS

Attention is directed to the following copending applications assigned to the assignee of the present application: U.S. application Ser. No. 08/841,033 filed Apr. 29, 1997, entitled, "Coated Development Electrodes and Methods Thereof;" now U.S. Pat. No. 5,761,587, U.S. application Ser. No. 08/841,136 filed Apr. 29, 1997, entitled, "Organic Coated Development Electrodes and Methods Thereof;" now U.S. Pat. No. 5,782,329, U.S. application Ser. No. 08/841,234 filed Apr. 29, 1997, entitled "Inorganic Coating Compositions for Development Electrodes and Methods Thereof;" and U.S. application Ser. No. 08/841,034 filed Apr. 29, 1997, entitled, "Composite Coated Development Electrodes and Methods Thereof" now U.S. Pat. No. 5,778,290. The disclosures of each of these applications are hereby incorporated by reference in their entirety.

BACKGROUND OF THE INVENTION

The present invention relates to methods, processes and apparatii for development of images, and more specifically, to electrode members for use in a developer unit in electrophotographic printing or copying machines, or in digital imaging systems such as the Xerox Corporation 220 and 230 machines. Specifically, the present invention relates to methods and apparatii in which at least a portion of a development unit electrode member is coated with a coating composition, and in embodiments, a low surface energy coating. In embodiments, electrode member history, damping and/or toner accumulation is controlled or reduced.

Generally, the process of electrophotographic printing or copying includes charging a photoconductive member to a substantially uniform potential so as to sensitize the photoconductive member thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer into contact therewith. Two component and single component developers are commonly used. A typical two component developer comprises magnetic carrier granules having toner particles adhering triboelectrically thereto. A single component developer typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to a development zone. At least one, and preferably a plurality of electrode members are closely spaced to the donor roll in the development zone. An AC voltage is applied to the electrode members forming a toner cloud in the development zone. The electrostatic fields generated by the latent image attract toner from the toner cloud to develop the latent image.

Another type of a two component development system is a hybrid scavengeless development system which employs a magnetic brush developer roller for transporting carrier having toner adhering triboelectrically thereto. A donor roll is used in this configuration also to transport charged toner to a development zone. The donor roll and magnetic roller are electrically biased relative to one another. Toner is attracted to the donor roll from the magnetic roll. The electrically biased electrode members detach the toner from the donor roll forming a toner powder cloud in the development zone, and the latent image attracts the toner particles thereto. In this way, the latent image recorded on the photoconductive member is developed with toner particles.

Various types of development systems have hereinbefore been used as illustrated by the following:

U.S. Pat. No. 4,868,600 to Hays et al., the subject matter of which is hereby incorporated by reference in its entirety, describes an apparatus wherein a donor roll transports toner to a region opposed from a surface on which a latent image is recorded. A pair of electrode members are positioned in the space between the latent image surface and the donor roll and are electrically biased to detach toner from the donor roll to form a toner cloud. Detached toner from the cloud develops the latent image.

U.S. Pat. No. 4,984,019, to Folkins, the subject matter of which is hereby incorporated by reference in its entirety, discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. No. 5,124,749 to Bares, the subject matter of which is hereby incorporated by reference in its entirety, discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at a position of attachment to the electrode supporting members for the purpose of damping vibration of the electrode wires.

U.S. Pat. Nos. 5,300,339 and 5,448,342 both to Hays et al., the subject matter each of which is hereby incorporated by reference in their entirety, disclose a coated toner transport roll containing a core with a coating thereover.

U.S. Pat. No. 5,172,170 to Hays et al., the subject matter of which is hereby incorporated by reference in its entirety, discloses an apparatus in which a donor roll advances toner to an electrostatic latent image recorded on a photoconductive member. The donor roll includes a dielectric layer disposed about the circumferential surface of the roll between adjacent grooves.

Primarily because the adhesion force of the toner particles is greater than the stripping force generated by the electric field of the electrode members in the development zone, a toner tends to build up on the electrode members. Accumulation of toner particles on the electrode or wire member causes non-uniform development of the latent image, resulting in print defects. This problem is aggravated by toner fines and any toner components, such as high molecular weight, crosslinked and/or branched components, and the voltage breakdown between the wire member and the donor roll.

One specific example of toner contamination results upon development of a document having solid areas which require a large concentration of toner to be deposited at a particular position on the latent image. The areas of the electrode member corresponding to the high throughput or high toner concentration areas tend to include higher or lower accumulation of toner because of this differing exposure to toner throughput. When subsequently attempting to develop another, different image, the toner accumulation on the electrode member can lead to differential development of the newly developed image corresponding to the areas of greater or lesser toner accumulation on the electrode members. The result is a darkened or lightened band in the position corresponding to the solid area of the previous image. This is particularly evident in areas of intermediate density, since these are the areas most sensitive to differences in development. These particular image defects caused by toner accumulation on the electrode wires at the development zone are referred to as wire history. FIG. 5 contains an illustration of wire contamination and wire history. Wire contamination results when fused toner forms between the electrode member and donor member due to toner fines and any toner components, such as high molecular weight, crosslinked and/or branched components, and the voltage breakdown between the wire member and the donor roll. Wire history is a change in developability due to toner or toner components sticking to the top of the electrode member.

Accordingly, there is a specific need for electrode members in the development zone of a development unit of an electrophotographic printing or copying machine which provide for a decreased tendency for toner accumulation to thereby primarily decrease wire history and wire contamination, especially at high throughput areas, and decreasing the production of unwanted surface static charges from which contaminants may not release. One possible solution is to change the electrical properties of the wire. However, attempts at decreasing toner build-up on the wire member by changing the electrical properties thereof, may result in an interference with the function of the wire and its ability to produce the formation of the toner powder cloud. Therefore, there is a specific need for electrode members which have a decreased tendency to accumulate toner and which also retain their electrical properties in order to prevent interference with the functioning thereof. There is an additional need for electrode members which have superior mechanical properties including durability against severe wear the electrode member receives when it is repeatedly brought into contact with tough rotating donor roll surfaces.

SUMMARY OF THE INVENTION

Examples of objects of the present invention include:

It is an object of the present invention to provide an apparatus for reducing toner accumulation of electrode members in the development zone of a developing unit in an electrophotographic printing apparatus with many of the advantages indicated herein.

Another object of the present invention is to provide an apparatus for reducing toner adhesion to electrode members.

It is another object of the present invention to provide an apparatus comprising electrode members having a lower surface energy.

It is yet another object of the present invention to provide an apparatus comprising electrode members having increased mechanical strength.

Still yet another object of the present invention is to provide an apparatus comprising electrode members which have superior electrical properties.

A further object of the present invention is to provide an apparatus comprising electrode members which have smooth surfaces.

Many of the above objects have been met by the present invention, in embodiments, which includes: an apparatus for developing a latent image recorded on a surface, comprising: wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating composition on at least a portion of nonattached regions of said electrode member, wherein said coating composition comprises a polymer, a lubricant and an inorganic material.

Embodiments further include: an electrophotographic process comprising: a) forming an electrostatic latent image on a charge-retentive surface; b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and a low surface energy coating composition on at least a portion of nonattached regions of said electrode member, wherein said coating composition comprises a polymer, a lubricant and an inorganic material; c) transferring the toner image from said charge-retentive surface to a substrate; and d) fixing said toner image to said substrate.

The present invention provides electrode members which, in embodiments, have a decreased tendency to accumulate toner and which also, in embodiments, retain their electrical properties in order to prevent interference with the functioning thereof. The present invention further provides electrode members which, in embodiments, have superior mechanical properties including durability against severe wear the electrode member receives when it is repeatedly brought into contact with tough rotating donor roll surfaces.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
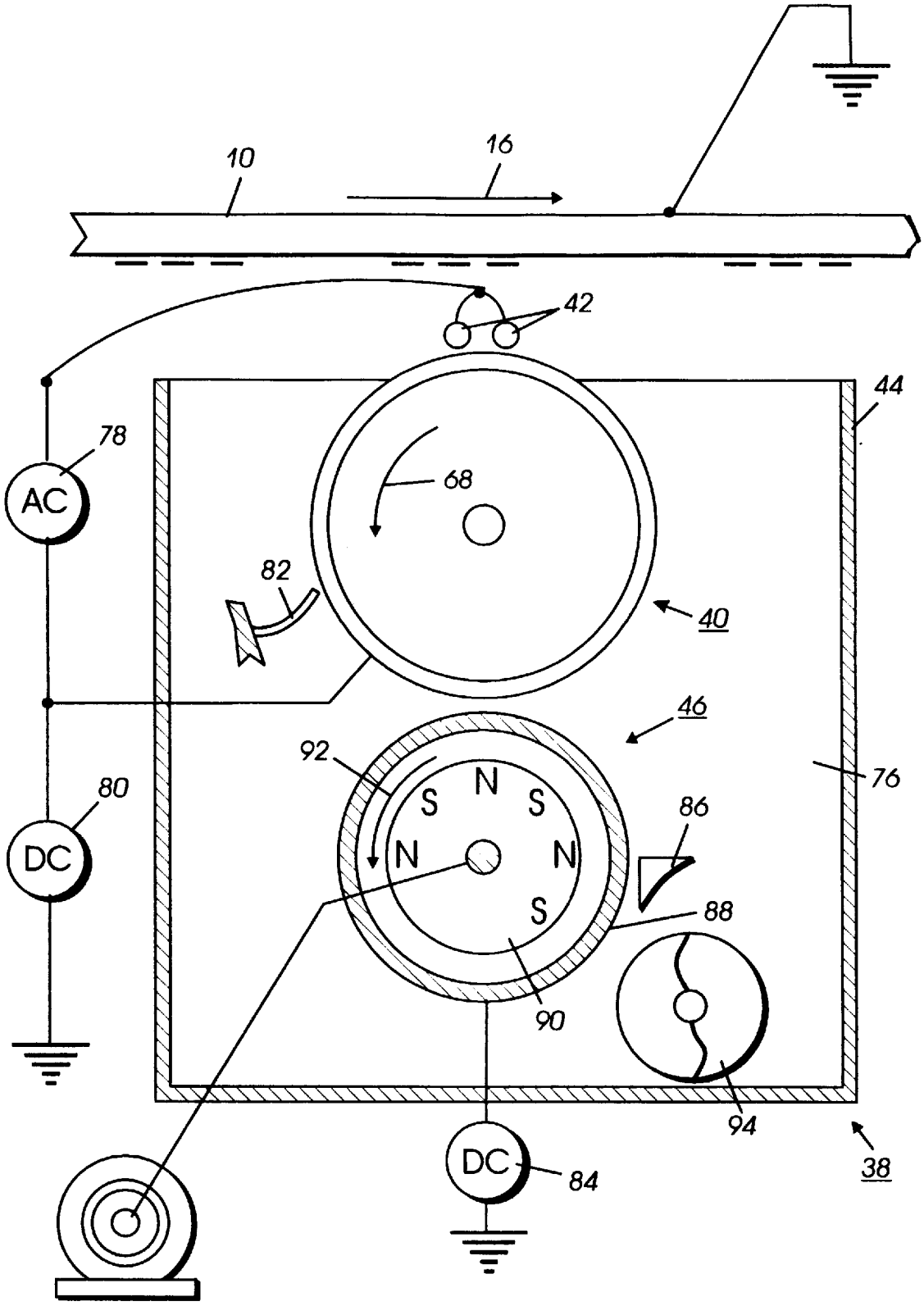
FIG. 1 is a schematic illustration of an embodiment of a development apparatus useful in an electrophotographic printing machine.

FIG. 1 shows a development apparatus used in an electrophotographic printing machine such as that illustrated and described in U.S. Pat. No. 5,124,749, the disclosure of which is hereby incorporated by reference in its entirety. This patent describes the details of the main components of an electrophotographic printing machine and how these components interact. The present application will concentrate on the development unit of the electrophotographic printing machine. Specifically, after an electrostatic latent image has been recorded on a photoconductive surface, a photoreceptor belt advances the latent image to a development station. At the development station, a developer unit develops the latent image recorded on the photoconductive surface.

Referring now to FIG. 1, in a preferred embodiment of the invention, developer unit 38 develops the latent image recorded on the photoconductive surface 10 moving in direction 16. Preferably, developer unit 38 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

More specifically, developer unit 38 includes a housing 44 defining a chamber 76 for storing a supply of two component (toner and carrier) developer material therein. Donor roller 40, electrode members 42 and magnetic roller 46 are mounted in chamber 76 of housing 44. The donor roller can be rotated in either the 'with' or 'against' direction relative to the direction of motion of belt 10. In FIG. 1, donor roller 40 is shown rotating in the direction of arrow 68. Similarly, the magnetic roller can be rotated in either the 'with' or 'against' direction relative to the direction of motion of belt 10. In FIG. 1, magnetic roller 46 is shown rotating in the direction of arrow 92. Donor roller 40 is preferably made from anodized aluminum or ceramic.

Developer unit 38 also has electrode members 42 which are disposed in the space between the belt 10 and donor roller 40. A pair of electrode members are shown extending in a direction substantially parallel to the longitudinal axis of the donor roller. The electrode members are made from of one or more thin (i.e., 50 to 100 $\mu$m in diameter) stainless steel or tungsten electrode members which are closely spaced from donor roller 40. The distance between the electrode members and the donor roller is from about 0.001 to about 45 $\mu$m, preferably about 10 to about 25 $\mu$m or the thickness of the toner layer on the donor roll. The electrode members are self-spaced from the donor roller by the thickness of the toner on the donor roller. To this end, the extremities of the electrode members supported by the tops of end bearing blocks also support the donor roller for rotation. The electrode member extremities are attached so that they are slightly above a tangent to the surface, including toner layer, of the donor structure. Mounting the electrode members in such a manner makes them insensitive to roll run-out due to their self-spacing.

As illustrated in FIG. 1, an alternating electrical bias is applied to the electrode members by an AC voltage source 78. The applied AC establishes an alternating electrostatic field between the electrode members and the donor roller is effective in detaching toner from the photoconductive member to the donor roller and forming a toner cloud about the electrode members, the height of the cloud being such as not to be substantially in contact with the belt 10. The magnitude of the AC voltage is relatively low and is in the order of about 200 to about 500 volts peak at a frequency ranging from about 9 kHz to about 15 kHz. A DC bias supply 80 which applies approximately 300 volts to donor roller 40 establishes an electrostatic field between the photoconductive member of belt 10 and donor roller 40 for attracting the detached toner particles from the cloud surrounding the electrode members to the latent image recorded on the photoconductive member. At a spacing ranging from about 0.001 $\mu$m to about 45 $\mu$m between the electrode members and donor roller, an applied voltage of about 200 to about 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantial charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer are depleted. A toner dispenser (not shown) stores a supply of toner particles which may include toner and carrier particles. The toner dispenser is in communication with chamber 76 of housing 44. As the concentration of toner particles in the developer is decreased, fresh toner particles are furnished to the developer in the chamber from the toner dispenser. In an embodiment of the invention, the auger in the chamber of the housing mix the fresh toner particles with the remaining developer so that the resultant developer therein is substantially uniform with the concentration of toner particles being optimized. In this way, a substantially constant amount of toner particles are present in the chamber of the developer housing with the toner particles having a constant charge. The developer in the chamber of the developer housing is magnetic and may be electrically conductive. By way of example, in an embodiment of the invention wherein the toner includes carrier particles, the carrier granules include a ferromagnetic core having a thin layer of magnetite overcoated with a non-continuous layer of resinous material. The toner particles may be generated from a resinous material, such as a vinyl polymer, mixed with a coloring material, such as chromogen black. The developer may comprise from about 90% to about 99% by weight of carrier and from 10% to about 1% by weight of toner. However, one skilled in the art will recognize that any other suitable developers may be used.

In an alternative embodiment of the present invention, one component developer comprised of toner without carrier may be used. In this configuration, the magnetic roller 46 is not present in the developer housing . This embodiment is described in more detail in U.S. Pat. No. 4,868,600, the disclosure of which is hereby incorporated by reference in its entirety.

Figure 2:
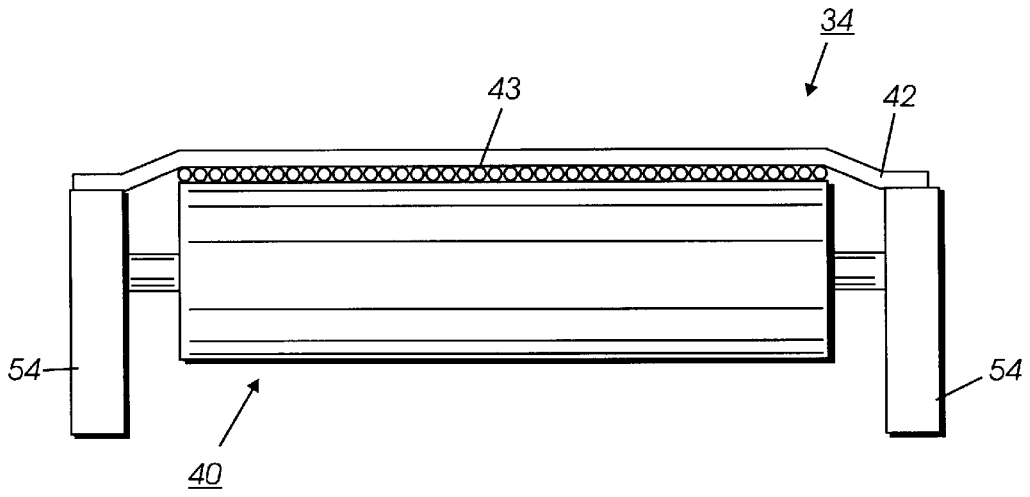
FIG. 2 is an enlarged, schematic illustration of a donor roll and electrode member representing an embodiment of the present invention.

An embodiment of the developer unit is further depicted in FIG. 2. The developer apparatus 34 comprises an electrode member 42 which is disposed in the space between the photoreceptor (not shown in FIG. 2) and the donor roll 40. The electrode 42 can be comprised of one or more thin (i.e., about 50 to about 100 $\mu$m in diameter) tungsten or stainless steel electrode members which are lightly positioned at or near the donor structure 40. The electrode member is closely spaced from the donor member. The distance between the wire(s) and the donor member is approximately 0.001 to about 45 $\mu$m, and preferably from about 10 to about 25 $\mu$m or the thickness of the toner layer 43 on the donor roll. The wires as shown in FIG. 2 are self spaced from the donor structure by the thickness of the toner on the donor structure. The extremities or opposed end regions of the electrode member are supported by support members 54 which may also support the donor structure for rotation. In a preferred embodiment, the electrode member extremities or opposed end regions are attached so that they are slightly below a tangent to the surface, including toner layer, of the donor structure. Mounting the electrode members in such a manner makes them insensitive to roll runout due to their self-spacing.

Figure 3:
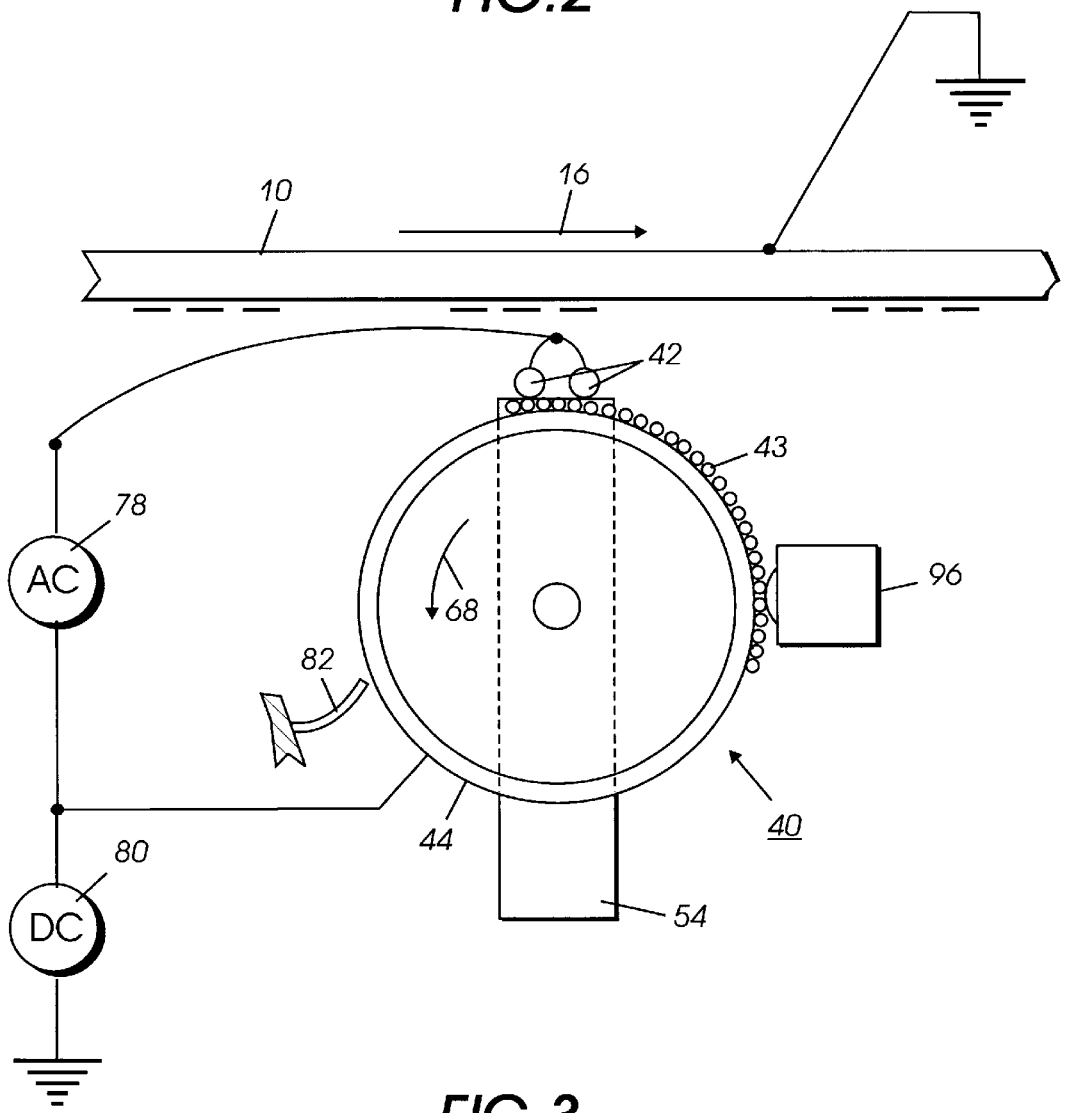
FIG. 3 is a fragmentary schematic illustration of a development housing comprising a donor roll and an electrode member from a different angle than as shown in FIG. 2.

In an alternative embodiment to that depicted in FIG. 1, the metering device 96 is replaced by a combined metering and charging blade 86 as shown in FIG. 3. The combination metering and charging device may comprise any suitable device for depositing a monolayer of well charged toner onto the donor structure 40. For example, it may comprise an apparatus such as that described in U.S. Pat. No. 4,459,009, wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure, or a donor roller alone used with one component developer.

Figure 4:
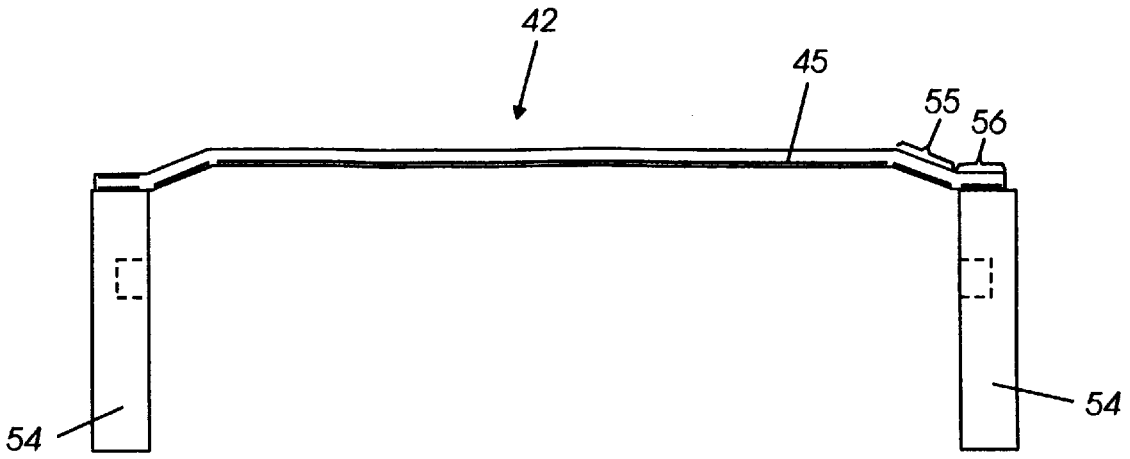
FIG. 4 is an enlarged, schematic illustration of an electrode member supported by mounting means in an embodiment of the present invention.

FIG. 4 depicts an enlarged view of a preferred embodiment of the electrode member of the present invention. Electrode wires 45 are positioned inside electrode member 42. The anchoring portions 55 of the electrode members are the portions of the electrode member which anchor the electrode member to the support member. The mounting sections 56 of the electrode member are the sections of the electrode members between the electrode member and the support member or mounting means 54.

Toner particles are attracted to the electrode members primarily through electrostatic attraction. Toner particles adhere to the electrode members because the adhesion force of the toner is larger than the stripping force generated by the electric field of the electrode member. Generally, the adhesion force between a toner particle and an electrode member is represented by the general expression $F_{ad}=q^2/kr^2+W$, wherein $F_{ad}$ is the force of adhesion, q is the charge on the toner particle, k is the effective dielectric constant of the toner and any dielectric coating, and r is the separation of the particle from its image charge within the wire which depends on the thickness, dielectric constant, and conductivity of the coating. Element W is the force of adhesion due to short range adhesion forces such as van der Waals and capillary forces. The force necessary to strip or remove particles from the electrode member is supplied by the electric field of the wire during half of its AC period, qE, plus effective forces resulting from mechanical motion of the electrode member and from bombardment of the wire by toner in the cloud. Since the adhesion force is quadratic in q, adhesion forces will be larger than stripping forces.

Figure 5:
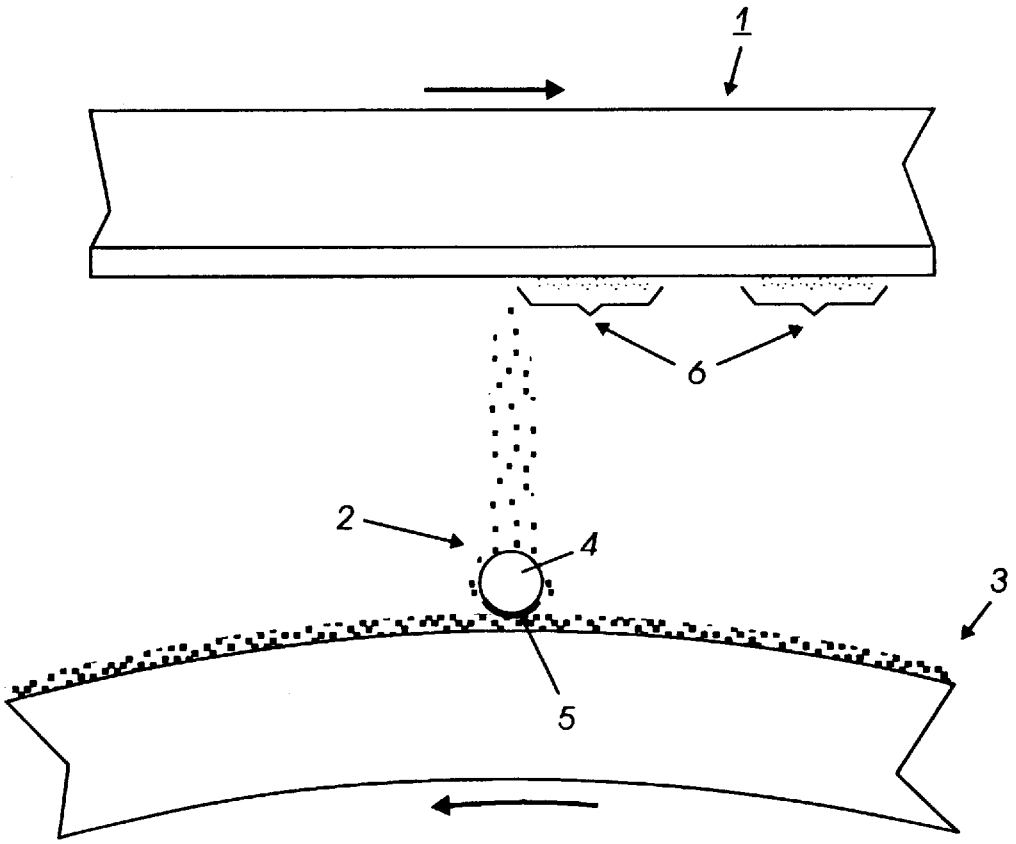
FIG. 5 is an illustration of wire contamination and wire history.

FIG. 5 contains an illustration of wire contamination and wire history. A photoreceptor 1 is positioned near wire 4 and contains an undeveloped image 6 which is subsequently developed by toner originating from donor member 3. Wire contamination occurs when fused toner 5 forms between the wire 4 and donor member 3. The problem is aggravated by toner fines and any toner components, such as high molecular weight, crosslinked and/or branched components, and the voltage breakdown between the wire member and the donor roll. Wire history is a change in developability due to toner 2 or toner components sticking to the top of the wire 4, the top of the wire being the part of the wire facing the photoreceptor.

In order to prevent the toner defects associated with wire contamination and wire history, the electrical properties of the electrode member can be changed, thereby changing the adhesion forces in relation to the stripping forces. However, such changes in the electrical properties of the electrode member may adversely affect the ability of the electrode member to adequately provide a toner cloud, which is essential for developing a latent image. The present invention is directed to an apparatus for reducing the unacceptable accumulation of toner on the electrode member while maintaining the desired electrical and mechanical properties of the electrode member. The electrode member of the present invention is coated with a material coating that reduces the significant attraction of toner particles to the electrode member which may result in toner accumulation. However, the material coating does not adversely interfere with the mechanical or electrical properties of the electrode member. Materials having these qualities include compositions with a low surface energy.

The low surface energy composition decreases the accumulation of toner by assuring electrical continuity for charging the wires and eliminates the possibility of charge build-up. In addition, such low surface energy materials as described herein do not interfere with the electrical properties of the electrode member and do not adversely affect the electrode's ability to produce a toner powder cloud. Moreover, the electrode member maintains its tough mechanical properties, allowing the electrode member to remain durable against the severe wear the electrode member receives when it is repeatedly brought into contact with tough, rotating donor roll surfaces. Also, the electrode member maintains a "smooth" surface after the coating is applied. A smooth surface includes surfaces having a surface roughness of less than about 5 microns, preferably from about 0.01 to about 1 micron.

Examples of suitable low surface energy compositions include both inorganic and organic materials. In a preferred embodiment of the invention, both organic and inorganic materials are used together in a coating composition. In embodiments, the coating composition comprises a polymer, a lubricant and an inorganic material.

Examples of suitable polymer materials include polymers having for example the physical properties of high toughness, low surface energy, high lubricity, and wear resistance. Although any polymer having the above characteristics is suitable for use as a composition coating, preferred examples of polymers include epoxy resins; formaldehyde resins such as phenol formaldehyde resins and melamine formaldehyde resin; alkyd resins; polysulfones such as polyethersulfone; polyesters; polyimides such as polyetherimide, polyamide imide sold for example under the tradename Torlon® 7130 available from Amoco; polyketones such as those sold for example under the tradename Kadel® E1230 available from Amoco, polyether ether ketone sold for example under the tradename PEEK 450GL30 from Victrex, polyaryletherketone; polyamides such as polyphthalamide sold under the tradename Amodel® available from Amoco; polyparabanic acid; and silicone resins. Particularly preferred examples of polymers include thermoset polymers and thermoplastic polymers, particularly a thermosetting alloy, a relatively high temperature stable thermoplastic, or a relatively low temperature thermoset, such as epoxy polymers, polyamides, polyimides, polysulfones, formladehyde resins, polyketones, polyesters, formaldehyde resins, and mixtures thereof.

The polymer or polymers is present in the composition coating in a total amount of from about 25 to about 95 percent by weight, and preferably from about 50 to about 90 percent by weight of the total composition. Mixtures of thermoset or thermoplastic materials can also be used. Total composition, as used herein, refers to the total amount by weight of polymer, lubricant and inorganic material, wherein the inorganic material comprises for example reinforcer(s) and/or electrically conductive filler(s).

In a preferred embodiment, a lubricant is present in the coating composition. The primary purpose of the lubricant is to provide a non-sticky nature to the top surface of the coating so that the toner does not adhere to the electrode member. The lubricant preferably has the characteristics of relatively low porosity, relatively low coefficient of friction, thermal stability, relatively low surface energy, and possesses the ability to be relatively inert to chemical attack. Preferred examples of suitable lubricants include organic material such as, for example, fluoroplastic materials including TEFLON®-like materials such as polymers of tetrafluoroethylene (TFE) and polymers of fluorinated ethylene-propylene (FEP), such as, for example, polytetrafluoroethylene (PTFE), fluorinated ethylenepropylene copolymer (FEP), perfluorovinylalkylethertetrafluoroethylene copolymer (PFA TEFLON®), polyethersulfone, and copolymers thereof; and inorganic materials such as molybdenum disulfide, boron nitride, titanium diboride, graphite, and the like. In embodiments, a lubricant or mixture of lubricants, is present in a total amount of from about 3 to about 50 percent by weight, and preferably from about 5 to about 25 percent by weight of total coating composition.

In embodiments, the coating composition comprises an inorganic material. An added inorganic filler can improve the composition toughness as well as tailor other properties such as color, and electrical and thermal conductivity of the polymer matrix. The added filler can also help to form a smooth surface for the coating composition. Preferred inorganic materials include conductive fillers and reinforcers. Examples of electrically conductive fillers include metal oxides such as tin oxide, titanium oxide, zirconium oxide, magnesium oxide and the like. Another preferred filler is carbon black, graphite or the like, with surface treatment of compounds such as for example, siloxane, silane, fluorine or the like. Specifically preferred treated carbon blacks include fluorinated carbons such as those described in co-pending U.S. patent application Ser. No. 08/635,356 filed Apr. 19, 1996, the disclosure of which is hereby incorporated by reference in its entirety. More than one electrically conductive filler may be present in the coating composition. In preferred embodiments, an electrically conductive filler or fillers is present in a total amount of from about 2 percent by weight to about 25 percent by weight and preferably from about 5 to about 12.5 percent by weight of total composition.

Examples of reinforcers include materials having the ability to increase the strength, hardness, and/or abrasion resistance of the polymer and/or thermoset or thermoplastic material. Examples of suitable reinforcers include carbon black, and thermal and furnace blacks; and further include metal oxides such as zinc oxide, silicon dioxide, titanium dioxide, and the like; carbonates such as magnesium carbonate and calcium carbonate and the like, and other materials such as hydrated silicas; and mixtures thereof. In preferred embodiments, a reinforcer or reinforcers is present in a total amount of from about 2 to about 25 percent by weight, and preferably from about 5 to about 12.5 percent by weight of total composition.

The composition may comprise a polymer, lubricant and reinforcer; a polymer lubricant and electrically conductive filler; or a polymer lubricant, reinforcer and electrically conductive filler. In preferred embodiments, the polymer is a thermoset or thermoplastic material, particularly a high temperature stable thermoplastic, or a low temperature thermoset; the lubricant is FEP, PFA, PTFE, and/or $MoS_2$; the electrically conductive filler, if present, is carbon black; and the reinforcer, if present, is silicone dioxide or titanium dioxide. The resulting matrix includes the properties of all elements of the composition, including having high lubricity and low surface energy from the lubricant, having an overall high wear resistance due to the polymer component and reinforcers, and having a smooth surface and superior electrical properties due to the inorganic component including the reinforcer(s) and/or inorganic filler(s).

The coating composition material is preferably present in an amount of from about 5 to about 95 percent by weight of total solids, and preferably from about 10 to about 40 percent by weight of total solids. Total solids refers to the total amount by weight of coating composition, solvent, optional fillers, and optional additives contained in the coating solution.

The volume resistivity of the coated electrode is for example from about $10^{-10}$ to about $1^{-1}$ ohm-cm, and preferably from $10^{-5}$ to $10^{-1}$ ohm-cm. The surface roughness is less than about 5 microns and preferably from about 0.01 to about 1 micron. The coating has a relatively low surface energy of from about 5 to about 35 dynes/cm, preferably from about 10 to about 25 dynes/cm.

In a preferred embodiment of the invention, the coating composition is coated over at least a portion of the nonattached regions of the electrode member. The nonattached region of the electrode member is the entire outer surface region of the electrode minus the region where the electrode is attached to the mounting means 54 and minus the anchoring area (55 in FIG. 4). It is preferred that the coating cover the portion of the electrode member which is adjacent to the donor roll. In another preferred embodiment of the invention, the coating composition is coated in an entire area of the electrode member located in a central portion of the electrode member and extending to an area adjacent to the nonattached portion of the electrode member. This area includes the entire surface of the electrode member minus the anchoring area (55 in FIG. 4). In an alternative embodiment, the entire length of the electrode member is coated with the material coating, including the anchoring area 55 and mounting area 56. In embodiments, at least a portion refers to the non-attached region being coated, or from about 10 to about 90 percent of the electrode member.

Toner can accumulate anywhere along the electrode member, but it will not affect development unless it accumulates in the length of the electrode member near to the donor roll or on the length closest to the photoreceptor. Therefore, it is preferred that the material coating cover the electrode member along the entire length corresponding to the donor roll; and on the entire length corresponding to the photoreceptor.

The coating composition may be deposited on at least a portion of the electrode member by any suitable, known method. These deposition methods include liquid and powder coating, dip and spray coating, and ion beam assisted and RF plasma deposition. In a preferred deposition method, the composition coating is coated on the electrode member by dip coating. After coating, the coating composition is preferably air dried and cured at a temperature suitable for curing the specific composition material. Curing temperatures range from about 100° F. to about 1400° F., and preferably from about 120° F. to about 1200° F.

The average thickness of the coating is from about 1 to about 30 $\mu$m thick, and preferably from about 2 to about 10 $\mu$m thick. If the coating is applied to only a portion of the electrode member, the thickness of the coating may or may not taper off at points farthest from the midpoint of the electrode member. Therefore, the thickness of the coating may decrease at points farther away from the midpoint of the electrode.

The electrode members of the present invention, the embodiments of which have been described herein exhibit superior performance in terms of wear resistance and decreased accumulation of toner on the surface of the electrode member, while also maintaining electrical properties which stimulate production of powder cloud development without charge build-up. In addition, the electrode members herein exhibit superior mechanical properties such as durability against donor roll surfaces which are normally made of tough materials such as ceramics.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

EXAMPLE 1

Preparation of wire to be coated

A stainless steel wire of about 3 mil thickness was cleaned to remove obvious contaminants.

A dip coating apparatus consisting of a 1 inch (diameter) by 15 inches (length) glass cylinder sealed at one end to hold the liquid coating material was used for dip coating the wire. A cable attached to a Bodine Electric Company type NSH-12R motor was used to raise and lower a wire support holder that keeps the wire taut during the coating process. The dip and withdraw rate of the wire holder into and out of the coating solution was regulated by a motor control device from B&B Motors & Control Corporation, (NOVA PD DC motor speed control). After coating, a motor driven device was used to twirl the wire around its axis while it received external heating to allow for controlled solvent evaporation. When the coating was dry and/or non-flowable, the coated wire was heated in a flow through oven using a time and temperature schedule to complete either drying or cure/post cure of the coating.

The general procedure may include: (A) cleaning and degreasing the wire with an appropriate solvent, for example, acetone, alcohol or water, and roughened if necessary by, for example, sand paper; (B) the coating material may be adjusted to the proper viscosity and solids content by adding solids or solvent to the solution; and (C) the wire is dipped into and withdrawn from the coating solution, dried and cured/post cured, if necessary, and dipped again, if required. The coating thickness and uniformity are a function of withdrawal rate and solution viscosity, (solids content in most solvent based systems) and a drying schedule consistent with the uniform solidification of the coating.

EXAMPLE 2

Preparation of composition coating solutions

A 2.5 mil stainless steel wire can be prepared by lightly grit blasting, sanding or rubbing the wire surface with steel wool, degreasing with acetone and then rinsing with an isopropyl alcohol, and drying. The clean wire may be primed with Whitford P-51 or Dow Corning 1200 primer using any convenient technique such as the conventional spray or dip/spin methods. The coating material is XYLAN® (1052 wb/black) supplied by Whitford Corporation, West Chester, Pa., which contains solids such as carbon black, lubricants such as molybdenum disulfide and polytetrafluoroethlyene, in a thermoset matrix. The viscosity can be adjusted with deionized water to a 30 to 45 Zahn cup No. 2 immediately (a few seconds) before spraying. This dispersion can then be dip coated onto an electrode as described in Example 1. A coating flash or air dry is optional; however to achieve optimum release, the cure time is preferably about 10 minutes at approximately 650° F. The coating can be polished to obtain a smooth and dry thickness of 2–3 microns thick.

EXAMPLE 3

A 2.5 mil stainless steel wire can be prepared by lightly grit blasting, degreasing with acetone and then rinsing with an isopropyl alcohol rinse, followed by a mild sodium hypochlorite solution wash, a water rinse, a dry alcohol rinse, and drying. A primer is optional in this example. "XYLAN® High Lubricty Blue" can be used as the coating material. This coating material is supplied by Whitford Corporation, and contains calcium carbonate as a reinforcer, and lubricants such as polytetrafluoroethlyene, in a thermoset matrix.

This coating composition can be coated on the electrode wire as in accordance with the procedures outlined in Example 1. The recommended dip application temperature is preferably between 70° and 80° F., and the desired application solution viscosity is between about 20 and 30 seconds using a Zahn No. 2. If a thinner coating is desired, water can be used as the diluent. The coated wire can be air dried for about 2 minutes at room temperature (about 25° C.) and then baked for about 20 minutes at approximately 200° F. This coating is expected to be medium soft and have a high lubricity.

EXAMPLE 4

A wire in accordance with Example 1 was degreased as in Example 2 or, optionally, can be vapor degreased. A mild sanding or grit blasting as in example 2 was followed by a dry alcohol wash. A primer application is optional but if one used, XYLAN® Primer P-501 is recommended. The coating suspension used was Whitford's XYLAN® 1052 DF/880 BLACK COATING, and the constituents include molybdenum disulfide, polytetrafluoroethylene, and Manganese Ferrite Black Spinel in a thermal set polymer matrix. The coating solution viscosity was approximately 32 Zahn Cup seconds. The coating may have to be diluted with Whitford Solvent 99B to obtain the desired dry thickness. This dispersion was then used to dip coat the electrode wire as described in Example 1. Immediately following coating, the coating is preferably flashed for about 5 minutes at approximately 200° F., followed by curing for about 15 minutes at approximately 400° F. The resultant smooth coating was less than 5 microns thick, exhibited high temperature stability, wear resistance and demonstrated adequate lubricity.

EXAMPLE 5

The procedure set out in Example 4 can be repeated except that ferrite can be substituted with a highly conductive carbon black in order to increase the electrical conductivity to within a range of about $10^{-10}$ to about $10^{-1}$, and preferably $10^{-5}$ to about $10^{-1}$ ohms-cm.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to said wire supports adapted to support the opposed end regions of said electrode member; and a coating composition on at least a portion of nonattached regions of said electrode member, wherein said coating composition comprises a polymer, a lubricant and an inorganic material.

2. An apparatus in accordance with claim 1, wherein said polymer is selected from the group consisting of epoxy polymers, polyamides, polyimides, polysulfones, formaldehyde resins, polyketones, polyesters, and mixtures thereof.

3. An apparatus in accordance with claim 1, wherein said lubricant is selected from the group consisting of fluoroplastics, molybdenum disulfide, polyethersulfones, boron nitride, titanium diboride, graphite and mixtures thereof.

4. An apparatus in accordance with claim 3, wherein said fluoroplastics is selected from the group consisting of polytetrafluoroethylene, fluorinated ethylenepropylene copolymer, perfluorovinylalkylethertetrafluoroethylene copolymer, and mixtures thereof.

5. An apparatus in accordance with claim 1, wherein said inorganic material is selected from the group consisting of an electrically conductive filler, a reinforcer, and mixtures thereof.

6. An apparatus in accordance with claim 5, wherein said electrically conductive filler is selected from the group consisting of metal oxides, carbon black, graphite, surface treated carbon black, and mixtures thereof.

7. An apparatus in accordance with claim 6, wherein said electrically conductive filler is selected from the group consisting of tin oxide, titanium oxide, zirconium oxide, magnesium oxide, fluorinated carbon, and mixtures thereof.

8. An apparatus in accordance with claim 5, wherein said reinforcer is selected from the group consisting of carbon black, thermal blacks, furnace blacks, metal oxides, carbonates, hydrated silicas, and mixtures thereof.

9. An apparatus in accordance with claim 8, wherein said reinforcer is selected from the group consisting of zinc oxide, silicon dioxide, titanium dioxide, magnesium carbonate, calcium carbonate, and mixtures thereof.

10. An apparatus in accordance with claim 1, wherein said polymer is a thermoset material, said lubricant is selected from the group consisting of polytetrafluoroethylene, molybdenum disulfide, and mixtures thereof, and wherein said inorganic material is selected from the group consisting of carbon black, calcium carbonate, and mixtures thereof.

11. An apparatus in accordance with claim 10, wherein said polymer is selected from the group consisting of epoxy polymers, polyamides, polyimides, polysulfones, formaldehydes, polyketones, polyesters, and mixtures thereof.

12. An apparatus in accordance with claim 1, wherein said coating composition is dip coated onto said electroded member.

13. An apparatus in accordance with claim 1, wherein said coating composition is present on from about 10 to about 90 percent of said electrode member.

14. An apparatus in accordance with claim 1, wherein said coating composition is of a thickness of from about 1 μm to about 5 μm.

15. An apparatus in accordance with claim 1, wherein said electrode member includes at least one thin diameter wire.

16. An apparatus in accordance with claim 15, wherein said at least one thin diameter wire has a diameter of from about 50 to about 100 μm.

17. An apparatus in accordance with claim 1, wherein said electrode member is closely spaced from said donor member a distance of from about 0.001 to about 45 μm.

18. An electrophotographic process comprising:

a) forming an electrostatic latent image on a charge-retentive surface;

b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and a low surface energy coating composition on at least a portion of nonattached regions of said electrode member, wherein said coating composition comprises a polymer, a lubricant and an inorganic material;

c) transferring the toner image from said charge-retentive surface to a substrate; and d) fixing said toner image to said substrate.

* * * * *